US010937408B2

(12) United States Patent
McCutcheon et al.

(10) Patent No.: US 10,937,408 B2
(45) Date of Patent: Mar. 2, 2021

(54) NOISE CANCELLATION SYSTEM, NOISE CANCELLATION HEADPHONE AND NOISE CANCELLATION METHOD

(71) Applicant: ams AG, Premstaetten (AT)

(72) Inventors: Peter McCutcheon, Premstaetten (AT); Robert Alcock, Premstaetten (AT)

(73) Assignee: AMS AG, Premstaetten (AT)

( * ) Notice: Subject to any disclaimer, the term of this patent is extended or adjusted under 35 U.S.C. 154(b) by 0 days.

(21) Appl. No.: 16/642,652

(22) PCT Filed: Aug. 27, 2018

(86) PCT No.: PCT/EP2018/073012
§ 371 (c)(1),
(2) Date: Feb. 27, 2020

(87) PCT Pub. No.: WO2019/042930
PCT Pub. Date: Mar. 7, 2019

(65) Prior Publication Data

US 2020/0265826 A1 Aug. 20, 2020

(30) Foreign Application Priority Data

Sep. 1, 2017 (EP) ..... 17189001

(51) Int. Cl.
*G10K 11/178* (2006.01)

(52) U.S. Cl.
CPC ..... *G10K 11/17853* (2018.01); *G10K 2210/1081* (2013.01); *G10K 2210/3027* (2013.01);
(Continued)

(58) Field of Classification Search
CPC ..... G10K 11/17853; G10K 2210/1081; G10K 2210/3027; G10K 2210/3028; G10K 2210/3056; G10K 11/178
(Continued)

(56) References Cited

U.S. PATENT DOCUMENTS 5,138,664 A 8/1992 Kimura et al.
5,497,426 A * 3/1996 Jay ..... A61B 7/04 381/67

(Continued)

OTHER PUBLICATIONS

Signal Processing for Active Control; by Stephen Elliot. [Academic Press], 2001, Chapter 6.1.2, p. 274.

(Continued)

*Primary Examiner* — Harry S Hong
(74) *Attorney, Agent, or Firm* — MH2 Technology Law Group LLP

(57) ABSTRACT

A noise cancellation system for a noise cancellation enabled audio device comprises a first noise filter and a second noise filter, each being designed to process a noise signal, a combiner and an adaptation engine. The first noise filter has a first fixed frequency response matched to a high leakage condition of the audio device. The second noise filter has a second fixed frequency response matched to a low leakage condition of the audio device. The combiner is configured to provide a compensation signal based on a combination of an output of the first noise filter amplified with a first adjustable gain factor and an output of the second noise filter amplified with a second adjustable gain factor. The adaptation engine is configured to estimate a leakage condition of the audio device based on an error noise signal and to adjust at least one of the first and the second adjustable gain factors based on the estimated leakage condition.

15 Claims, 3 Drawing Sheets

(52) U.S. Cl.
CPC ..... *G10K 2210/3028* (2013.01); *G10K 2210/3056* (2013.01)

(58) Field of Classification Search
USPC ..... 381/71.6
See application file for complete search history.

(56) References Cited

U.S. PATENT DOCUMENTS

| | | | | |
|---|---|---|---|---|
| 7,031,460 | B1 | 4/2006 | Zheng et al. | |
| 8,963,700 | B2 | 2/2015 | Tanaka et al. | |
| 2010/0303256 | A1 | 12/2010 | Clemow | |
| 2012/0250873 | A1 | 10/2012 | Bakalos et al. | |
| 2013/0216060 | A1 | 8/2013 | Narayan et al. | |
| 2014/0051483 | A1 | 2/2014 | Schoerkmaier | |
| 2014/0072135 | A1 | 3/2014 | Bajic et al. | |
| 2015/0243271 | A1 | 8/2015 | Goldstein | |
| 2016/0210958 | A1* | 7/2016 | Gauger, Jr. ..... | H04R 3/002 |
| 2016/0300562 | A1 | 10/2016 | Goldstein | |
| 2017/0150246 | A1* | 5/2017 | Rule ..... | G10K 11/178 |

OTHER PUBLICATIONS

AES Article, AES E-Library—Approaches to Binaural Synthesis, Audio Engineering Society; http://www.aes.org/e-lib/browse.cfm?elib=8319 retrieved Sep. 5, 2017 2 pages.

European Patent Office, International Search Report for PCT/EP2018/073012 dated Dec. 3, 2018.

* cited by examiner

NOISE CANCELLATION SYSTEM, NOISE CANCELLATION HEADPHONE AND NOISE CANCELLATION METHOD

BACKGROUND OF THE INVENTION

The present disclosure relates to a noise cancellation system, to a noise cancellation headphone with such a system and to a noise cancellation method.

Nowadays a significant number of headphones, including earphones, are equipped with noise cancellation techniques. For example, such noise cancellation techniques are referred to as active noise cancellation or ambient noise cancellation, both abbreviated with ANC. ANC generally makes use of recording ambient noise that is processed for generating an anti-noise signal, which is then combined with a useful audio signal to be played over a speaker of the headphone. ANC can also be employed in other audio devices like handsets or mobile phones.

Various ANC approaches make use of feedback, FB, microphones, feedforward, FF, microphones or a combination of feedback and feedforward microphones.

For each system to work effectively, the headphone preferably makes a near perfect seal to the ear/head which does not change whilst the device is worn and that is consistent for any user. Any change in this seal as a result of a poor fit will change the acoustics and ultimately the ANC performance. This seal is typically between the ear cushion and the user's head, or between an earphone's rubber tip and the ear canal wall.

For most noise cancellation headphones and earphones, effort is put into maintaining a consistent fit when being worn and from user to user to ensure that the headphone acoustics do not change and always have a good match to the filter. However, "leaky" earphones and headphones, which do not make a seal between the ear cushion/tips and the ear, have a large variation in the acoustics when worn by different people. Furthermore the acoustics can vary for the user whilst the earphone moves in their ear as a result of typical everyday head movements. Therefore, for any headphones or earphones which are leaky, some adaptation is required to ensure the filter always matches the acoustics.

The most popular adaptive algorithms act to change a filter response by changing the filter coefficients directly. There are many variants of the core Least-Mean-Square, LMS, algorithm which have been used to tackle adaptive noise cancellation in the past. These include filtered-u LMS and filtered-x LMS. However, when an LMS algorithm is applied to an IIR filter, restrictions must be placed on the algorithm to prevent it from going unstable. These restrictions can limit the success of the adaption and slow it down.

SUMMARY OF THE INVENTION

The present disclosure provides an improved signal processing concept for noise cancellation in an audio device like a headphone or handset that improves noise reduction performance.

The improved signal processing concept is based on the idea that instead of having a single filter with adjustable filter characteristics, there are two or more filters having a fixed frequency response, respectively, that both process the same noise signal. The output of these filters is combined with respective adjustable gain factors that are adjusted based on an actual leakage condition of the audio device. The leakage condition can be estimated or determined based on an error noise signal.

The improved signal processing concept is e.g. achieved by implementing two or more fixed ANC filters in parallel. In its simplest form this will be two filters. One is tuned to match the acoustics of the audio device, e.g. an earphone, when worn at the most leaky possible position. The other is tuned to match the acoustics of the earphone when worn at its most sealed possible position. These two positions represent the extremes over which the earphones may be worn by anyone.

The two filters are then mixed to linearly interpolate between the two filter shapes. By adjusting the mix of these two filters a new resultant filter shape is achieved that can match any leakage setting in between these two extremes. The mix of these two filters is adjusted to minimize the signal at an error microphone positioned preferably in front of a speaker of the audio device.

The advantage is good noise cancellation performance over a wide range of leakages. This means that leaky earphones and handsets can implement noise cancellation. It also means that low end earphones and headphones which do not have a budget to implement low tolerance components and manufacturing processes can have better noise cancellation performance and a more reliable noise cancellation performance from person to person.

The improved signal processing concept is based on a new understanding that interpolating between two filters arranged in parallel can match the acoustics response of an earphone for several different leakages.

This approach can easily be extended to a greater number of noise filters, which are matched to one or more respective intermediate leakage conditions of the audio device. In that case, interpolation may be made between those filters being matched closest to the actual leakage condition determined.

As the output of the filters is changed only linearly by respective gain factors, the filters cannot become unstable, even if recursive filters are employed. Hence, the improved signal processing concept enables stable ANC.

In an embodiment of a noise cancellation system according to the improved signal processing concept, which is to be used for a noise cancellation enabled audio device like a headphone, earphone, mobile phone, handset or the like, the system comprises a first and a second noise filter, a combiner and an adaptation engine. The first noise filter has a first fixed frequency response matched to a high leakage condition of the audio device and is designed to process a noise signal. The second noise filter has a second fixed frequency response matched to a low leakage condition of the audio device and is designed to process the same noise signal as the first noise filter. The combiner is configured to provide a compensation signal based on a combination of an output of the first noise filter amplified with a first adjustable gain factor and an output of the second noise filter amplified with a second adjustable gain factor. The adaptation engine is configured to estimate a leakage condition of the audio device based on an error noise signal and to adjust at least one of the first and the second adjustable gain factors based on the estimated leakage condition. For example, a setting of both the first and the second adjustable gain factors is made, respectively adjusted. For example, the adjustment of the at least one of the first and the second adjustable gain factors is made during operation of the noise cancellation system.

In the following, the improved concept will be explained, sometimes referring to a headphone or earphone as an example of the audio device. However, it shall be appreciated that this example is not limiting and will also be understood by a skilled person for other kinds of audio devices where different leakage conditions can occur during usage by a user. In general the term audio device should include all types of audio reproducing devices.

For example, the first noise filter is pretuned to match the ANC target function of an earphone in a predefined highest leakage condition, for example using standard ANC filter matching techniques. Accordingly, the second noise filter is pretuned to match the ANC target function of an earphone in a predefined lowest leakage condition, again using standard techniques. The lowest leak and highest leak conditions represent the lowest possible and highest possible leak that the earphone is likely to be worn with. The lowest leak is typically a complete seal. The target function for these conditions is, for example, obtained by using a custom-made leakage adaptor on a head and torso simulator, or can be obtained by making measurements on a selection of test subjects. However, the determination of the fixed frequency responses of the first and the second noise filter is not the subject of the improved signal processing concept itself.

The error noise signal may be a feedback noise signal recorded by a feedback noise microphone located in proximity to a speaker of the audio device. Hence, the error noise signal contains information about noise portions in the audio signal played over the speaker.

Depending on the type of ANC, the noise signal to be processed by the first and the second noise filter may be either a signal recorded by an ambient noise microphone in case of a feedforward ANC implementation or be the error noise signal or an additional feedback noise signal in the case of a feedback ANC implementation.

For example, the adaptation engine is configured to estimate the leakage condition based on a noise evaluation of the error noise signal at one or more distinct frequencies or frequency ranges. For example, the noise contribution at these frequencies or frequency ranges indicates a present leakage condition.

In some implementations the adaptation engine is configured to estimate the leakage condition based on a filtered version of the error noise signal.

The evaluation of the noise signal can be performed in the analog domain as well as in the digital domain. The evaluation of the error noise signal can be performed in the time domain, e.g. by using bandpass filters with one or more pass bands, or in the frequency domain, for example employing FFT algorithms.

In some implementations, the adaptation engine is configured to adjust the first and the second adjustable gain factor using a mapping function, e.g. a polynomial mapping function, between the estimated leakage condition and the first and the second adjustable gain factor. The polynomial mapping includes both linear functions and non-linear functions.

In some implementations, the adaptation engine is configured to adjust the first and the second adjustable gain factor further based on an external input, e.g. a user input. For example, the external input determines or manipulates the mapping function between leakage condition and gain factors. However, the external input may also affect the evaluation of the error noise signal. For example, the external input may select the way of estimating the leakage condition, thereby having influence on e.g. the speed of estimation and setting of the gain factors. The external input may be provided by a user via an application running on the device that includes the ANC system.

In various implementations the combination performed in the combiner is a sum or a weighted sum. For example, the signals processed with the first and the second noise filter contribute to the compensation signal with a respective weight before adding them together.

In some implementations the combiner is further configured to provide a compensation signal based on the combination amplified with the supplementary adjustable gain factor. In such an implementation the adaptation engine is further configured to adjust the supplementary adjustable gain factor based on the estimated leakage condition. For example, the sum or weighted sum is further multiplied with the supplementary adjustable gain factor.

As mentioned before, the first and the second noise filter, respectively the noise cancellation system, can be either of a feedforward type or a feedback type ANC.

Accordingly, in some implementations the first noise filter and the second noise filter are each of a feedforward noise cancellation type. In such implementations, the noise signal is an ambient noise signal, e.g. recorded by an ambient noise microphone of the audio device. In some implementations, the error noise signal is a feedback noise signal. For example, the feedback noise signal is recorded by a feedback noise microphone located in proximity to a speaker of the audio device.

In some of such implementations, the adaptation engine may be configured to estimate the leakage condition based on a ratio between the error noise signal and the noise signal at one or more distinct frequencies or frequency ranges. For example, this allows to determine how much of noise contributions at specific frequencies being present in the ambient noise signal are also present in the error noise signal. For example, the lower the leakage condition, the lower the contribution in the error noise signal and vice versa.

In some other implementations, the first noise filter and the second noise filter are each of a feedback noise cancellation type. In such an implementation the noise signal as an input to the first and the second noise filter is the error noise signal, which is e.g. a feedback noise signal as explained above.

In some implementations the noise cancellation system can also be embodied as a hybrid ANC system having both feedforward ANC filters and feedback ANC filters. For example, such an implementation may be based on the feedforward implementation described above and further comprises a third noise filter and a fourth noise filter, each being of a feedback noise cancellation type and being designed to process the error noise signal. The third noise filter has a third fixed frequency response matched to the high leakage condition, and the fourth noise filter has a fourth fixed frequency response matched to the low leakage condition of the audio device. The compensation signal generated by the combiner from the first and the second noise filters being of the feedforward noise cancellation type is a feedforward compensation signal. The combiner is further configured to provide a feedback compensation signal based on a combination of an output of the third noise filter amplified with a third adjustable gain factor and an output of the fourth noise filter amplified with a fourth adjustable gain factor. The adaptation engine is further configured to adjust the third and fourth adjustable gain factors based on the estimated leakage condition.

In the various embodiments described above, the compensation signal, respectively feedforward compensation signal or feedback compensation signal, may be further processed by an audio processor which generates a resulting audio signal to be played over the speaker based on a useful audio signal and the respective compensation signal or signals. In case of feedback ANC applied, also the feedback error signal provided to the feedback filters may be preprocessed by the audio processor based on the useful audio signal, in order to take into account the portions of the useful audio signal in the feedback error signal. A specific implementation of such an audio processor having the filtered noise signals as an input is well-known to the skilled person, both for feedforward ANC and feedback ANC and is therefore not discussed in more detail herein.

In some implementations the noise cancellation system further comprises one or more further noise filters, each having a further fixed frequency response matched to a distinct medium leakage condition of the audio device and being designed to process the noise signal. The combiner is configured to provide the compensation signal based on a combination of the output of the first noise filter amplified with the first adjustable gain factor, the output of the second noise filter amplified with the second adjustable gain factor and respective outputs of the one or more further noise filters, each amplified with a respective further adjustable gain factor. The adaptation engine is further configured to adjust the respective further adjustable gain factors based on the estimated leakage condition. Such additional noise filters matched to some medium leakage conditions can be both applied to feedforward implementations or feedback implementations or even to the hybrid implementation. In the latter case, the number of filters for feedforward and for feedback can even be different.

According to the improved signal processing concept a noise cancellation enabled audio device, e.g. a headphone, earphone, mobile phone, handset or the like, comprises a noise cancellation system according to one of the embodiments described above, a speaker and a feedback noise microphone located in proximity to the speaker for providing the error noise signal. In general, instead of a noise cancellation enabled device, also an audio player could include a noise cancellation system enabled audio device according to one of the embodiments described above.

According to the improved signal processing concept, also a noise cancellation method for a noise cancellation enabled audio device is disclosed. The method comprises processing a noise signal with a first noise filter having a first fixed frequency response matched to a high leakage condition of the audio device, and processing the noise signal with a second noise filter having a second fixed frequency response matched to a low leakage condition of the audio device. A compensation signal is generated based on a combination of an output of the first noise filter amplified with a first adjustable gain factor and an output of the second noise filter amplified with a second adjustable gain factor. A leakage condition of the audio device is estimated based on an error noise signal. At least one of the first and the second adjustable gain factors are adjusted based on the estimated leakage condition. For example, a setting of both the first and the second adjustable gain factors is made, respectively adjusted. For example, the at least one of the first and the second adjustable gain factors is adjusted during operation of the noise cancellation system.

As discussed above for the various embodiments of the noise cancellation system, the first and the second noise filters can both be of a feedforward noise cancellation type or of a feedback noise cancellation type, having respective associated noise signals as their inputs. Various further embodiments of the noise cancellation method become apparent for the skilled reader from the various embodiments described above for the noise cancellation system.

BRIEF DESCRIPTION OF THE DRAWINGS

The improved signal processing concept will be described in more detail in the following with the aid of drawings. Elements having the same or similar function bear the same reference numerals throughout the drawings. Hence their description is not necessarily repeated in following drawings.

In the drawings.

DETAILED DESCRIPTION

Figure 1:
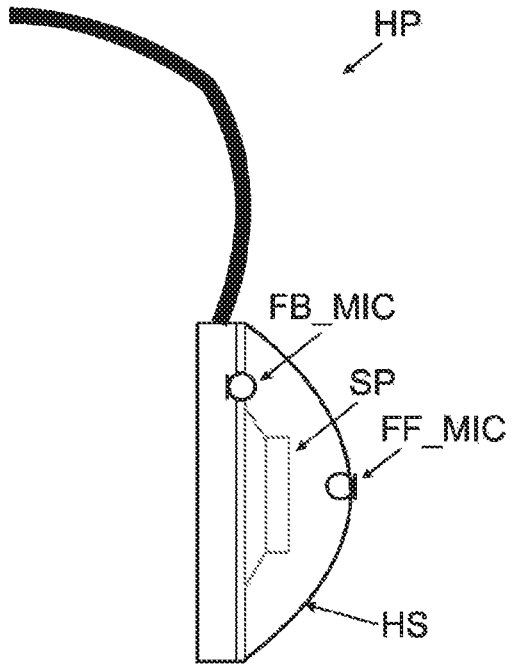
FIG. 1 shows a schematic view of a headphone.

FIG. 1 shows a schematic view of an ANC enabled headphone HP that in this example is designed as an over-ear or circumaural headphone. Only a portion of the headphone HP is shown, corresponding to a single audio channel. However, extension to a stereo headphone will be apparent to the skilled reader. The headphone HP comprises a housing HS carrying a speaker SP, a feedback noise microphone FB_MIC and an ambient noise microphone FF_MIC. The feedback noise microphone FB_MIC is particularly directed or arranged such that it records both ambient noise and sound played over the speaker SP. Preferably the feedback noise microphone FB_MIC is arranged in close proximity to the speaker, for example close to an edge of the speaker SP or to the speaker's membrane. The ambient noise microphone FF_MIC is particularly directed or arranged such that it mainly records ambient noise from outside the headphone HP.

Depending on the type of ANC to be performed, the ambient noise microphone FF_MIC may be omitted, if only feedback ANC is performed. The feedback noise microphone FB_MIC may be used according to the improved signal processing concept to provide an error noise signal being the basis for a determination of the wearing condition, respectively leakage condition, of the headphone HP, when the headphone HP is worn by a user.

ANC performance usually depends on this wearing condition because the filter characteristics of an ANC filter are conventionally trimmed to a specific condition. For example, this condition determines how tight or sealed the headphone HP, taken as an example for audio devices, is positioned against the user. If the headphone HP is moved, this condition changes and so do the acoustic properties. For instance, the headphone can be worn in a low leakage condition, where only a small amount of ambient noise can enter the headphone and reach the feedback microphone FB_MIC. In another wearing condition, a high leakage condition, ambient noise can reach inside the headphone and the feedback microphone FB_MIC. Various conditions exist in between these two extremes.

Figure 2:
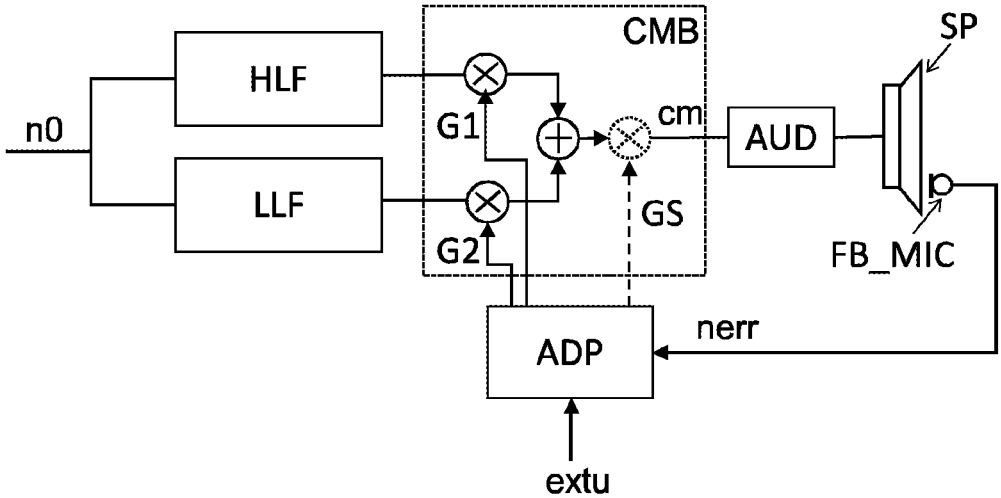
FIGS. 2 to 6 show different implementation examples of a noise cancellation system.

Referring now to FIG. 2, a schematic block diagram of an example implementation of the improved signal processing concept is shown. The implementation comprises a first noise filter HLF and a second noise filter LLF, which are both input with a noise signal n0, such that both filters process the same signal. A first noise filter HLF has a first fixed frequency response that is matched to the high leakage condition of the audio device, for example the headphone HP. The second noise filter has a second fixed frequency response that is matched to the low leakage condition of the audio device. Accordingly, the output of the first noise filter HLF alone could be used for ANC processing if the audio device is in the high leakage condition. Similarly, if the audio device is in the low leakage condition, the output of the second noise filter LLF could be used for ANC processing alone.

The implementation further includes a combiner CMB that combines the outputs of the first and the second noise filter HLF, LLF amplified with a first adjustable gain factor G1 and a second adjustable gain factor G2, respectively. For example, the combination is performed by summing up the amplified versions of the filter output signals. This sum can be directly used as a compensation signal cm or optionally be amplified with a supplementary gain factor GS. The compensation signal cm may then be used by an audio processor AUD that combines the compensation signal cm with a useful audio signal s0 according to the implemented ANC structure. The output of the audio processor AUD, which may also include amplifiers etc., is then output to the speaker SP of the audio device.

The gain factors G1 and G2 and, optionally, GS, are adjusted by an adaptation engine ADP that is configured to estimate a leakage condition of the audio device based on an error noise signal nerr provided by the feedback microphone FB_MIC. The adaptation engine ADP adjusts the first and the second adjustable gain factor G1, G2 and, optionally, GS, based on the estimated leakage condition. For example, the adjustment of the at least one of the adjustable gain factors G1, G2 and, optionally, GS, is made during operation of the noise cancellation arrangement or the audio device including the arrangement.

As mentioned above, there is a relationship between an actual leakage condition and the amount of noise, in particular ambient noise that is able to enter the audio device and reach the feedback microphone FB_MIC. Hence, the adaptation engine e.g. performs a noise evaluation of the error noise signal nerr, for example at one or more frequencies or frequency ranges. For example, the selected frequencies are significant for ambient noise. As described above, the evaluation can be performed in the time domain as well as in the frequency domain with respective signal processing approaches.

The adaptation engine ADP may use a mapping function, e.g. a polynomial mapping function between the estimated leakage condition and the adjustable gain factors G1, G2 and GS. For example, the higher the leakage condition, the higher the gain factor G1 for the first noise filter while the second gain factor G2 for the second noise filter will decrease accordingly. Similarly, the lower the leakage condition is estimated to be, the greater the second gain factor G2 will be while decreasing the first gain factor G1.

The adaptation engine ADP may optionally be configured to adjust the first and the second adjustable gain factors G1, G2 further based on an external input extu, which may be a user input. For example, the external input extu determines or manipulates the mapping function between leakage condition and gain factors G1, G2 and GS. However, the external input extu may also affect the evaluation of the error noise signal nerr. For example, the external input extu may select the way of estimating the leakage condition, thereby having influence on e.g. the speed of estimation and setting of the gain factors G1, G2 and GS.

Accordingly, by controlling the mix of the two filters HLF, LLF, a resultant filter is produced which is a mix of the two filters HLF, LLF. As the actual leakage condition will continually change due to movement of a user's head, for the headphone example, so too does the resultant filter response. At any one time, the resulting filter response is a linear interpolation of the two noise filters.

The general concept for improved signal processing which has been described in conjunction with FIG. 2, will now be explained in more detail for feedforward noise cancellation systems in FIG. 3, a feedback noise cancellation system in FIG. 4 and a hybrid noise cancellation system in FIG. 6. FIG. 5 shows a general extension of the concept shown in FIG. 2. In conjunction with these figures, only the differences to the implementation of FIG. 2 may be explained. Features from FIG. 2 left out in the following Figures may nevertheless be used in these Figures.

Figure 3:
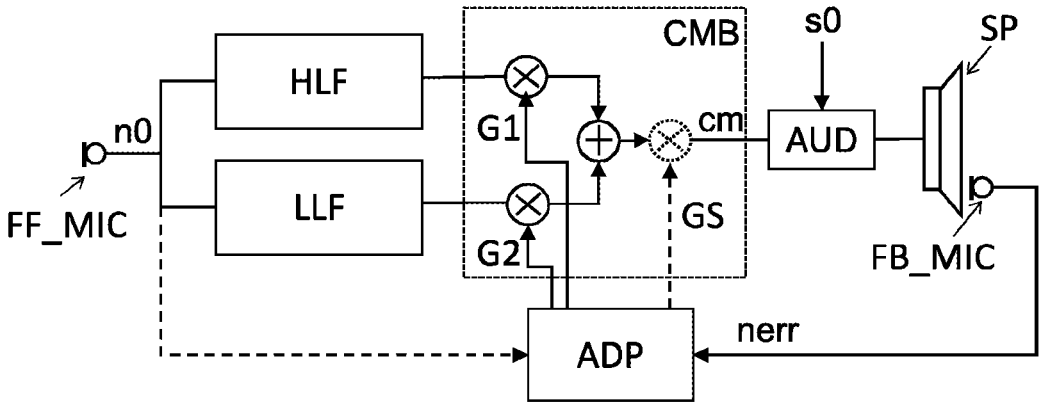

Referring now to FIG. 3, which shows a feedforward noise cancellation system, the noise signal n0 is provided by a feedforward microphone FF_MIC, as for example shown in FIG. 1 and serving the general purpose of providing a sole ambient noise signal. The audio processor AUD is therefore adapted accordingly in order to perform feedforward ANC.

The ambient noise signal n0 may optionally be provided to the adaptation engine ADP, which in such a configuration may be configured to estimate the leakage condition based on a ratio between the error noise signal nerr and the noise signal n0 at one or more distinct frequencies or frequency ranges. This allows to determine how much of the ambient noise recorded with the feedforward microphone FF_MIC, which can also be called an ambient noise microphone, is also present in the error noise signal nerr. Accordingly, the leakage condition can be estimated based on a relative value instead of an absolute value at the distinct frequencies, resulting in an improved estimation performance.

Figure 4:
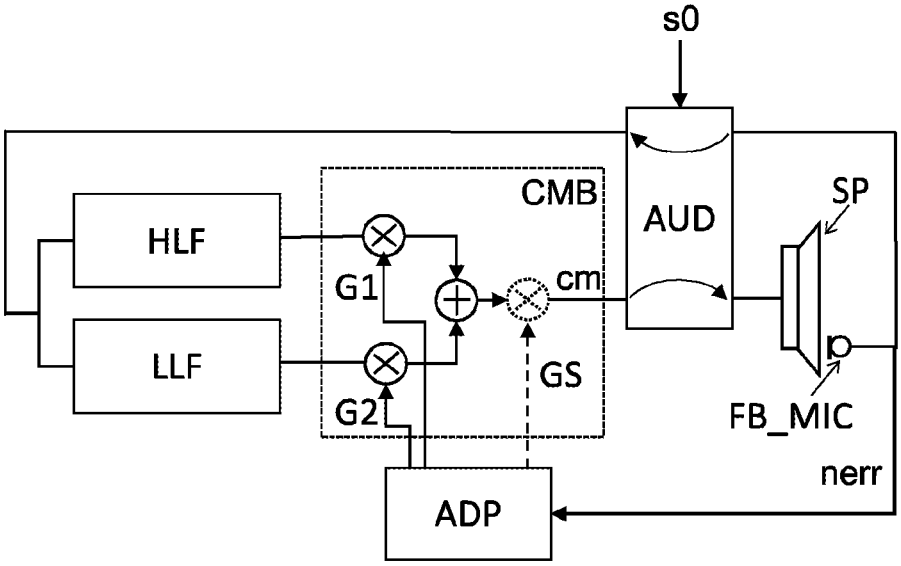
Figure 5:
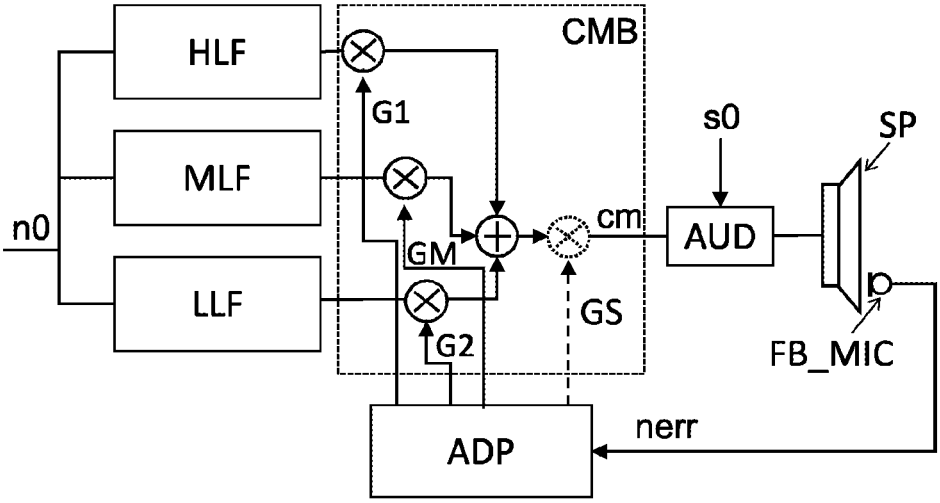

Referring now to FIG. 4, a feedback ANC system is shown, where the error noise signal nerr is also used as an input for the first and the second noise filters HLF, LFF. The audio processor AUD in this implementation is adapted accordingly to perform the feedback ANC based on the combined filter output. To this end, also the feedback error signal nerr provided to the feedback filters may be preprocessed by the audio processor AUD based on the useful audio signal s0, in order to take into account the portions of the useful audio signal s0 in the feedback error signal nerr.

Even if only feedback ANC is performed, but an ambient noise microphone like the microphone FF_MIC is present, the estimation on the leakage condition could also be performed using noise ratios between the error noise signal nerr and the noise signal provided by the ambient noise microphone, as described above for FIG. 3.

Referring now to FIG. 5, the basic concept shown in FIG. 2 is extended by using a further noise filter MLF having a further fixed frequency response that is matched to a medium leakage condition of the audio device. The medium leakage condition is particularly somewhere in between the high leakage condition and the low leakage condition. Accordingly, the compensation signal cm is formed in the combiner CMB by additionally summing up the output of the further noise filter MLF amplified with an adjustable gain factor GM.

The adaptation engine ADP in this implementation is hence further configured to adjust not only the first and the second gain factor G1, G2, but also the gain factor GM based on the estimated leakage condition. For example, one of the gain factors G1 and G2 can be set to zero if the estimated leakage condition is between the leakage condition associated with the further noise filter MLF and the respective other extreme leakage condition, such that it is only interpolated between two of the noise filters being matched closest to the actual leakage condition.

Further noise filters are matched to respective distinct leakage conditions. Moreover, the extension to three or more noise filters can both be applied to feedforward ANC and feedback ANC.

Figure 6:
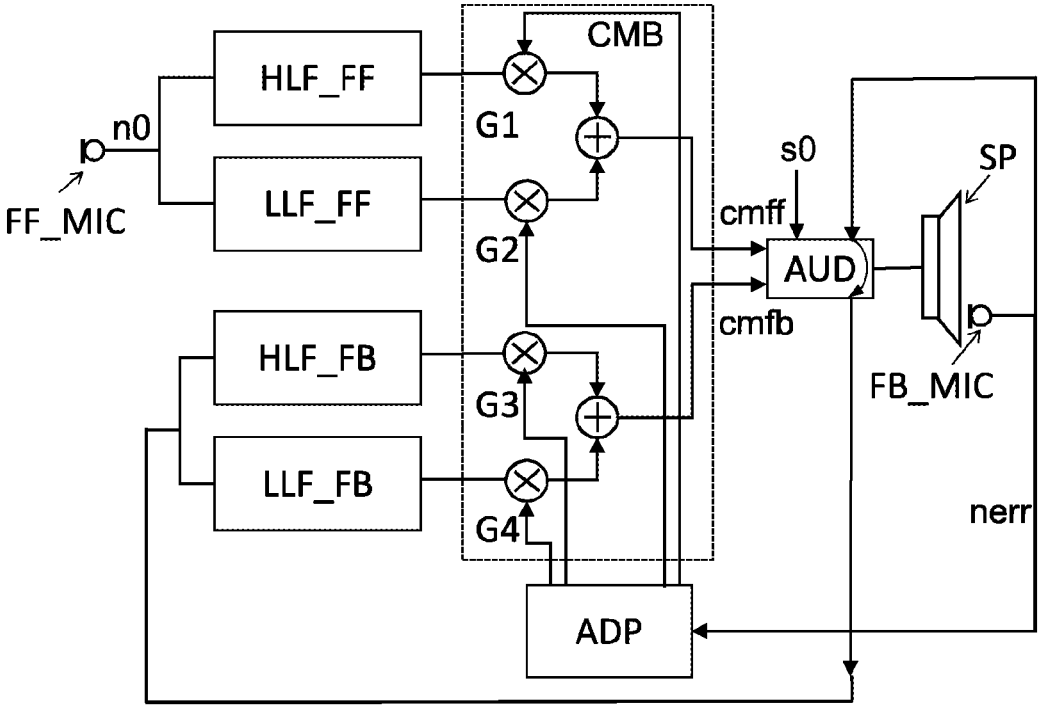

Referring now to FIG. 6, the general concept described in conjunction with FIG. 2 is applied to a hybrid ANC implementation employing both feedforward and feedback ANC.

Accordingly in this implementation, two filter pairs are present, one for the feedforward part and one for the feedback part. In particular, the feedforward part includes a first feedforward noise filter HLF FF matched to the high leakage condition and a second feedforward filter LLF FF matched to the low leakage condition. Similarly, for the feedback part, there is one filter HLF_FB matched to the high leakage condition and a filter LLF_FB matched to the low leakage condition. Each of the four filters is associated with a respective adjustable gain factor G1, G2 for the feedforward part and G3, G4 for the feedback part, each adjusted by the adaptation engine ADP according to the concept described above. The audio processor AUD uses the compensation signal cmff produced by the feedforward part and the feedback compensation signal cmfb for implementing the hybrid ANC. As explained above for FIG. 4, also the feedback error signal nerr provided to the feedback filters may be pre-processed by the audio processor AUD based on the useful audio signal s0, in order to take into account the portions of the useful audio signal s0 in the feedback error signal nerr.

A supplementary gain factor GS, shown in the previous implementations, has been left out of the example implementation of FIG. 6. However, one or both of the feedforward part and the feedback part can use a respective supplementary gain factor as well.

It should be noted that in all of the implementations described above, neither of the microphones FF_MIC, FB_MIC nor the speaker SP are essential parts of a noise cancellation system according to the improved signal processing concept. Even the audio processor AUD could be provided externally. For example, such a noise cancellation system could be implemented both in hardware and software, for example in a signal processor. The noise cancellation system can be located in any kind of audio player, like a mobile phone, an MP3 player, a tablet computer or the like. However, the noise cancellation system could also be located within the audio device, e.g. a mobile handset or a headphone, earphone or the like.

The invention claimed is:

1. A noise cancellation system for a noise cancellation enabled audio device, in particular headphone, the system comprising a first noise filter having a first fixed frequency response matched to a high leakage condition of the audio device and being designed to process a noise signal;

a second noise filter having a second fixed frequency response matched to a low leakage condition of the audio device and being designed to process the noise signal;

a combiner configured to provide a compensation signal based on a combination of an output of the first noise filter amplified with a first adjustable gain factor and an output of the second noise filter amplified with a second adjustable gain factor; and an adaptation engine configured to estimate a leakage condition of the audio device based on an error noise signal and to adjust at least one of the first and the second adjustable gain factors based on the estimated leakage condition; wherein the error noise signal is a feedback noise signal recorded by a feedback noise microphone located in proximity to a speaker of the audio device; and the first noise filter and the second noise filter are each of the same noise cancellation type, wherein the noise cancellation type is one of a feedforward noise cancellation type, wherein the noise signal is an ambient noise signal recorded by an ambient noise microphone of the audio device; and a feedback noise cancellation type, wherein the noise signal is the error noise signal.

2. The noise cancellation system according to claim 1, wherein the adaptation engine is configured to adjust the at least one of the first and the second adjustable gain factors during operation of the noise cancellation system.

3. The noise cancellation system according to claim 1, wherein the adaptation engine is configured to estimate the leakage condition based on a noise evaluation of the error noise signal at one or more distinct frequencies or frequency ranges.

4. The noise cancellation system according to claim 1, wherein the adaptation engine is configured to estimate the leakage condition based on a filtered version of the error noise signal.

5. The noise cancellation system according to claim 1, wherein the adaptation engine is configured to adjust the first and the second adjustable gain factor using a mapping function, in particular polynomial mapping function, between the estimated leakage condition and the first and the second adjustable gain factor.

6. The noise cancellation system according to claim 1, wherein the adaptation engine is configured to adjust the first and the second adjustable gain factor further based on an external input, in particular a user input.

7. The noise cancellation system according to claim 1, wherein the combiner is further configured to provide the compensation signal based on the combination amplified with a supplementary adjustable gain factor and wherein the adaptation engine is further configured to adjust the supplementary adjustable gain factor based on the estimated leakage condition.

8. The noise cancellation system according to claim 1, wherein the error noise signal is a feedback noise signal recorded by a feedback noise microphone located in proximity to a speaker of the audio device.

9. The noise cancellation system according to claim 1, wherein the first noise filter and the second noise filter are each of a feedforward noise cancellation type, and the adaptation engine is configured to estimate the leakage condition based on a ratio between the error noise signal and the noise signal at one or more distinct frequencies or frequency ranges.

10. The noise cancellation system according to claim 1, wherein the first noise filter and the second noise filter are each of a feedforward noise cancellation type, the system further comprising a third noise filter being of a feedback noise cancellation type, having a third fixed frequency response matched to the high leakage condition of the audio device and being designed to process the error noise signal;

a fourth noise filter being of a feedback noise cancellation type, having a fourth fixed frequency response matched to the low leakage condition of the audio device and being designed to process the error noise signal; wherein the compensation signal is a feedforward compensation signal;

the combiner is configured to provide a feedback compensation signal based on a combination of an output of the third noise filter amplified with a third adjustable gain factor and an output of the fourth noise filter amplified with a fourth adjustable gain factor; and the adaptation engine is further configured to adjust the third and fourth adjustable gain factors based on the estimated leakage condition.

11. The noise cancellation system according to claim 1, the system further comprising one or more further noise filters, each being of the same noise cancellation type as the first noise filter and the second noise filter and having a further fixed frequency response matched to a distinct medium leakage condition of the audio device and being designed to process the noise signal; wherein the combiner is configured to provide the compensation signal based on a combination of the output of the first noise filter amplified with the first adjustable gain factor, the output of the second noise filter amplified with the second adjustable gain factor and respective outputs of the one or more further noise filters, each amplified with a respective further adjustable gain factor; and the adaptation engine is further configured to adjust the respective further adjustable gain factors based on the estimated leakage condition.

12. A noise cancellation enabled audio device, in particular headphone or handset, comprising a noise cancellation system according to claim 1, a speaker and a feedback noise microphone located in proximity to the speaker for providing the error noise signal.

13. An audio player comprising a noise cancellation system according to claim 1.

14. A noise cancellation method for a noise cancellation enabled audio device, in particular headphone, the method comprising processing a noise signal with a first noise filter having a first fixed frequency response matched to a high leakage condition of the audio device;

processing the noise signal with a second noise filter having a second fixed frequency response matched to a low leakage condition of the audio device;

generating a compensation signal based on a combination of an output of the first noise filter amplified with a first adjustable gain factor and an output of the second noise filter amplified with a second adjustable gain factor;

estimating a leakage condition of the audio device based on an error noise signal; and adjusting at least one of the first and the second adjustable gain factors based on the estimated leakage condition; wherein the error noise signal is a feedback noise signal recorded by a feedback noise microphone located in proximity to a speaker of the audio device; and the first noise filter and the second noise filter are each of the same noise cancellation type, wherein the noise cancellation type is one of a feedforward noise cancellation type, wherein the noise signal is an ambient noise signal recorded by an ambient noise microphone of the audio device; and a feedback noise cancellation type, wherein the noise signal is the error noise signal.

15. The method according to claim 14, wherein the at least one of the first and the second adjustable gain factors is adjusted during operation of the noise cancellation audio device.

* * * * *